US005661117A

United States Patent [19]

Dufresne

[11] Patent Number: 5,661,117

[45] Date of Patent: Aug. 26, 1997

[54] REGENERATION OF PHOSPHATE ESTER LUBRICATING FLUIDS

[76] Inventor: Peter Dufresne, 428 Coachlight Bay S.W., Calgary, Alberta, Canada, T3H 1Z2

[21] Appl. No.: 421,771

[22] Filed: Apr. 14, 1995

[51] Int. Cl.[6] ..... C10M 137/04

[52] U.S. Cl. ..... 508/433; 58/150; 75/710

[58] Field of Search ..... 252/49.8, 49.9; 508/433; 558/150; 75/710

[56] References Cited

U.S. PATENT DOCUMENTS

| | | | |
|---|---|---|---|
| 3,708,508 | 1/1973 | Schultz . | |
| 4,092,378 | 5/1978 | Damiani | 260/990 |
| 4,205,023 | 5/1980 | Anzenberger | 260/990 |
| 4,264,534 | 4/1981 | Anzenberger | 260/990 |
| 4,302,335 | 11/1981 | Habermas | 210/651 |
| 4,741,857 | 5/1988 | Horwitz et al. . | |
| 5,364,452 | 11/1994 | Cupertino et al. | 423/22 |
| 5,464,551 | 11/1995 | Deetman | 252/78.5 |

*Primary Examiner*—Jacqueline V. Howard
*Attorney, Agent, or Firm*—Paul Sharpe; McFadden, Fincham

[57] ABSTRACT

A method of removing contaminated phosphate ester materials is provided. The method involves the use of an anionic resin and a polymeric sorbent. The contaminated phosphate ester material is passed into contact with the anionic resin and optionally the sorbent. The method is particularly useful since it removes substantially all of the contaminants, generally metal material and acids, from the phosphate ester such that the phosphate ester can be reused for further applications.

16 Claims, 11 Drawing Sheets

| METAL | NEW FLUID | DEGRADED FLUID |
|---|---|---|
| | p.p.m. | p.p.m. |
| *Al* | 0 | 13 |
| *Cr* | 7 | 9 |
| *Fe* | 0 | 1 |
| *Na* | 0 | 236 |
| *Si* | 6 | 0 |
| *Ca* | 1 | 4 |
| *Mg* | 1 | 1 |
| *Total* | 15 | 264 |

FIG. 6

REGENERATION OF PHOSPHATE ESTER LUBRICATING FLUIDS

FIELD OF THE INVENTION

The present invention relates to the regeneration of phosphate ester lubricating fluids and more particularly, the present invention is directed to the use of an anionic exchange resin for decontaminating such fluids.

BACKGROUND OF THE INVENTION

Generally speaking, gas turbine engines, steam turbines and other related hydraulic systems employ phosphate ester fluid lubricants, an example of which is phosphate ester fluid as the primary lubricating material. Although a particularly useful lubricant, the fluid is vulnerable to thermal degradation which results in the generation of acid contaminants in the form of phosphorus and phosphoric acids along with a variety of metal salts from acidic corrosion of internal gas turbine metals.

In an attempt to provide for possible cleaning methods, the prior art has provided filtration of the degraded fluid through Fuller's earth and/or activated alumina for the removal of acids from the thermal degradation. Recently, fluid filtration has progressed to continuous side stream treatment and has employed acid adsorbent medias which include activated alumina for acid removal.

Regarding the activated alumina and Fuller's earth, although these filter media are generally useful in the process of adsorbing acids, they contribute to the contamination level in the fluid and this has a significant impact on fluid quality and therefore operation of the apparatus employing this fluid. In the case of the Fuller's earth, adsorbed acids dissolve free calcium and magnesium which are naturally abundant in the Fuller's earth media. The calcium and magnesium enter the lubricating fluid as a soluble metal-salt and electrolytically plate out on hot engine components such as shafts, bearings and seals. The result is premature component wear and concomitant failure.

Similarly, activated alumina although generally understood to be a better adsorbent, additionally contributes sodium as a metal to the fluid. The problem is particularly pronounced when the sodium level becomes elevated beyond 90 parts per million (p.p.m.). At this level, or greater, the sodium has a tendency to react with the additional fluid degradation products in the lubricant to produce, for example, sodium phosphate and phosphites. Generally speaking, sodium phosphates chemically are commonly known as detergent soaps. The result can produce severe fluid foaming which, in turn, can cause lube oil pump cavitation as well as bearing and seal failures.

In an attempt to satiate the difficulties associated with decontaminating lubricant fluid of this variety, the art has proposed numerous methods, typical of which is indicated in U.S. Pat. No. 4,741,857, issued May 3, 1988 to Horwitz et al. Horwitz et al. teaches a method of purifying neutral organophosphorus extractants which primarily involves the mixing together of CMPO, TBP and NPH. The compounds are mixed together to form an organic extractant that is adapted to pick up the radiolytic and hydrolytic degradation products. In view of the fact that the acids are in both forms, i.e., salt and acid, the method requires both cation and anionic exchanges. The disclosure indicates that the extractants are contacted for at least 30 minutes with agitation. Further, the process is a two step process where the material to be treated must be contacted with the cation exchange in a first step to form a first solution and then subsequently contacted with the anion resin to complete the acid removal.

The above process is clearly limited in that it involves extensive treatment time and cannot produce a substantially contaminant free fluid rapidly and in a single pass through a single ionic exchange material.

Further prior art related to purification of fluids using ionic resins includes U.S. Pat. No. 3,708,508, issued to Schulz. The method is directed to the purification and recovery of tri-n-butylphosphate used in reprocessing nuclear fuel.

In view of what has been previously proposed in the art, it would be desirable to have a more efficient process where a spent or degraded lubrication fluid could be cleansed while in use without removal. This clearly has advantages in terms of reducing the probability of damage from using contaminated lubricant, clear cost savings since the material can be reused, as well as reducing the volume of chemical compounds which have to be handled carefully from an environmental point of view.

SUMMARY OF THE INVENTION

One object of the present invention is to provide an improved process for decontaminating and rejuvenating a lubricating fluid containing metal compounds and acidified contaminants.

A further object of the present invention is to provide a method of cleansing a phosphate ester lubricant contaminated with metal material and acids, the method comprising the steps of: providing a source of phosphate ester lubricant; providing a source of an anionic resin; passing the phosphate ester lubricant into contact with the resin; and removing the metal compounds and the acids with the resin to provide a substantially contaminant free reusable lubricating fluid.

Applicability of the method is widespread. The method can be employed to decontaminate and rejuvenate spent lubricating fluid or employed to rejuvenate newly manufactured phosphate fluid lubricants that do not meet new fluid specifications due to high acid levels or other such contamination. With respect to the latter point, this is particularly advantageous since in the prior art, the "off-spec" fluid could not be decontaminated using existing technology without recontaminating the fluid with additional metals, for example, magnesium and calcium, in the case of Fuller's earth.

Generally speaking, the contaminants typically found in lubricating fluids used in turbine engines include phosphoric and phosphorous acids along with various metal salt compounds formed from acidic corrosion of different metals utilized in gas engine turbine technology.

It has been found that use of an anionic resin is particularly useful for removing not only the metal salt compounds, but also for deacidifying the lubricating fluid. With passage of the contaminated fluid through the resin, new quality lubricating fluid has been created. As an optional processing step, the method may include a subsequent treatment of the decontaminated fluid with a polymeric ionic exchange sorbent. This is useful for removing any free phenols in the decontaminated lubricating fluid.

In one form, the anionic resin may comprise a polystyrene anionic resin, an example of which is Dowex M43 manufactured by the Dow Chemical Company.

The method may be practised in a continuous manner and may be employed with a turbine engine or hydraulic system where apparatus is attached directly to a suitable area of the machine. This permits the fluid to be continuously treated and therefore reduces the likelihood that the apparatus becomes damaged due to the use of a contaminated lubricating fluid.

Further, the fluid may be recirculated for several treatments or continuously. A further object of the present invention is to provide a system for decontaminating a bearing lubricant fluid contaminated with metal material and acids, the system comprising: at least one container for retaining an anionic resin, the container having an inlet for receiving a contaminated fluid therein and an outlet for discharging substantially contaminant free fluid; means for introducing the fluid into the inlet of the container; and means for recirculating the fluid from the outlet of the container into the inlet of the container for subsequent passage.

Having thus generally described the invention, reference will now be made to the accompanying drawings, illustrating preferred embodiments.

BRIEF DESCRIPTION OF THE DRAWINGS

FIG. 6 is a graphical representation of the total metals reduction in parts per million for various sample numbers taken from reservoir A;

DETAILED DESCRIPTION OF THE PREFERRED EMBODIMENTS

Figure 1:
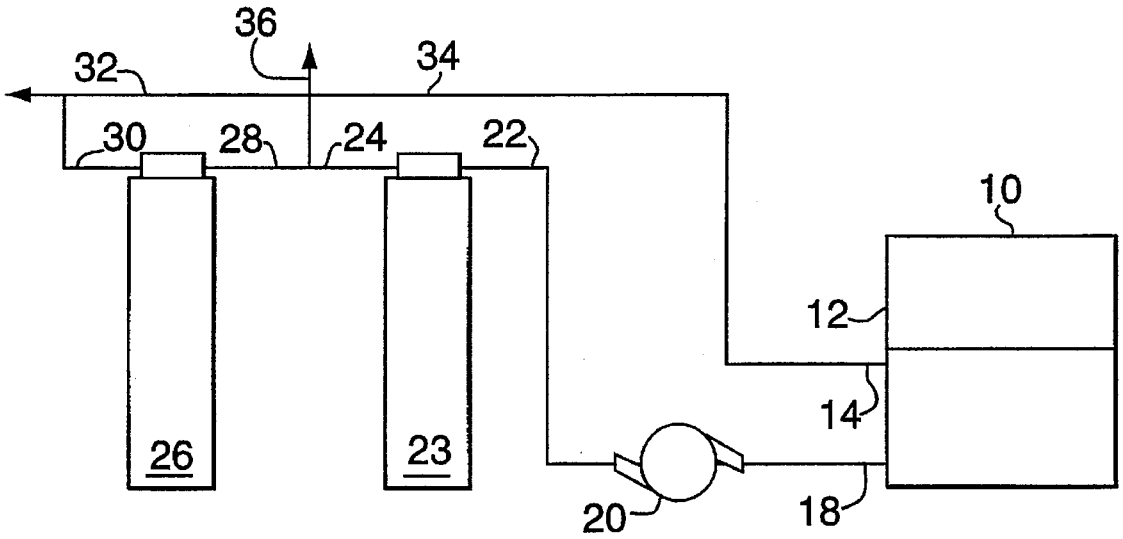
FIG. 1 is a schematic illustration of the apparatus according to one embodiment of the present invention.

FIG. 1 illustrates schematically one possible embodiment of the apparatus, globally denoted by numeral 10. The lubricating fluid may be passed into a preliminary storage vessel 12 by inlet 14 thereon, the fluid being indicated in the reservoir 12 at 16. It will be clearly understood that the lubricating fluid, may be fed into vessel 12 or further that vessel 12 may be directly connected to an apparatus employing the lubricating fluid which would permit real time treatment of the fluid.

Tubing, globally denoted by numeral 18, permits fluid communication between the vessel 12 or other source of the fluid with the additional elements in the system to be discussed hereinafter. Fluid 16 is pumped through the system 10 via pump 20, which pump 20 introduces the fluid to be treated into a first source of anionic resin at inlet 22. Once the fluid has been passed through the source of anionic resin, the same is passed out outlet 24 of the anionic resin. The source of resin may comprise a column 23 or a resin bed or other suitable form of resin container.

Once treated with the anionic resin, the fluid may be directed to any number of possible routes. As a first possibility, the fluid may be then subsequently passed on to a sorbent treatment for removal of any remaining phenols and other residual contaminants. Numeral 26 denotes the source of polymeric sorbent which may be positioned in a conventional ionic exchange column and passed therein by inlet 28 from outlet 24 of anionic treatment area. Once the fluid has been circulated through the polymeric sorbent, it is passed out outlet 30 of column 26 and may subsequently be passed to an device (not shown) employing the fluid via line 32 or back to the reservoir 12 by line 34 for recirculation through the system 10.

As a further possible alternative, once the fluid has been treated with the anionic exchange resin only and is passed out outlet 24, the fluid may be then directed, via line 36, to a device (not shown) which uses the fluid or recirculated through the system 10 via line 34.

Any number of sources of resin 23 and sorbent 26 may be employed with the system. Further, these may be linked in series or parallel or any combination of these.

Turning to greater details of the present invention, the anionic resin, may comprise a polystyrene anionic resin and as an example, Dowex M43 as manufactured by the Dow Chemical Company may be a suitable solution for the resin. Others will be appreciated by those skilled in the art. Generally speaking, the Dowex M43 polystyrene resin has a free moisture content of approximately 50% to 55% and when used as part of a gas turbine fluid reclamation process, does not require drying prior to use. Oil flow is established as one imperial gallon per cubic foot of resin on a side stream basis. Phenols associated with the degraded phosphate ester fluid are removed with the use of the polymeric ion exchange sorbent as set forth in FIG. 1 and denoted by numeral 26. This ion exchange sorbent has a very high internal surface area of up to 1000 square metres per gram ($m^2g^{-1}$). A preferred sorbent is Purolite MN-150.

In the lubricant field, lubricants for electrohydraulic control systems (EHC) are concerned with maintaining total acid number control (hereinafter referred to as TAN) for fluid lubricants. Generally, phosphate esters, isopropylphenyl phosphate ester (IPPP), and tertiary-butylphenyl phosphate (TBPP) are regarded as the choice compounds for lubrication purposes with phosphate-ester being an example. In the prior art, the previous methods of using Fuller's earth and alumina as well as other compounds such as diatomaceous earth etc. resulted in these processes being ineffectual to lower TAN levels to new fluid value, which must subscribe to a TAN value of 0.03.

Having thus generally described the overall apparatus, reference will now be made to the accompanying example.

Two severely degraded phosphate ester reservoirs (A and B) were installed with M-43 anionic filters.

EXAMPLE

M-43 Anionic Exchange Resin Test on Reservoirs A & B

Both of the reservoirs each contained 1.0 cubic feet of resin and a fluid flow rate of 6 imperial gallons per minute was established therethrough. Oil samples for TAN and metals were taken frequently. Each of the reservoirs were fitted with filters bearing the M43 resin. The fluid that was employed for the purpose of this example was TBPP. The resin in each case was packaged into a standard Hillco filter housing which is normally used to hold 6 Fuller's earth, activated alumina or Selexsorb-GT cartridges that are 11" in diameter by 19" long. In the present invention, a new cartridge was designed maintaining the industrial standard dimension of 11"×19" to satisfy the requirements of optimising columnar height when using a resin.

The 11"×19" filter used in each of the reservoirs comprises the following components: a filter body manufactured from 20 gauge mild steel unperforated, a lid composed of 20 gauge mild steel perforated with a 100 mesh stainless screen spot welded on the inside of the lid. This was found effective to prevent resin beads from exiting the filter. An unperforated bottom on the filter body with a centered drain tube attached was employed. The length of the tube was 2".

The filters as manufactured in this process have virtually no shelf life, due to the high water content of the M-43 resin and they are manufactured on an as required basis for immediate installation. Filter life is dependant on the severity of the turbine application, but typically the life varies from a minimum of 16 months to a maximum of 27 months. The filters are changed when oil lab analysis shows an increase in TAN above 0.07.

The design of the filter herein allows oil flow to enter the filter body through the holes in the top lid where it flows down through the resin at about 20 p.s.i.g. and exits the filter body through the holes in the bottom of the filter center tube.

Figure 2:
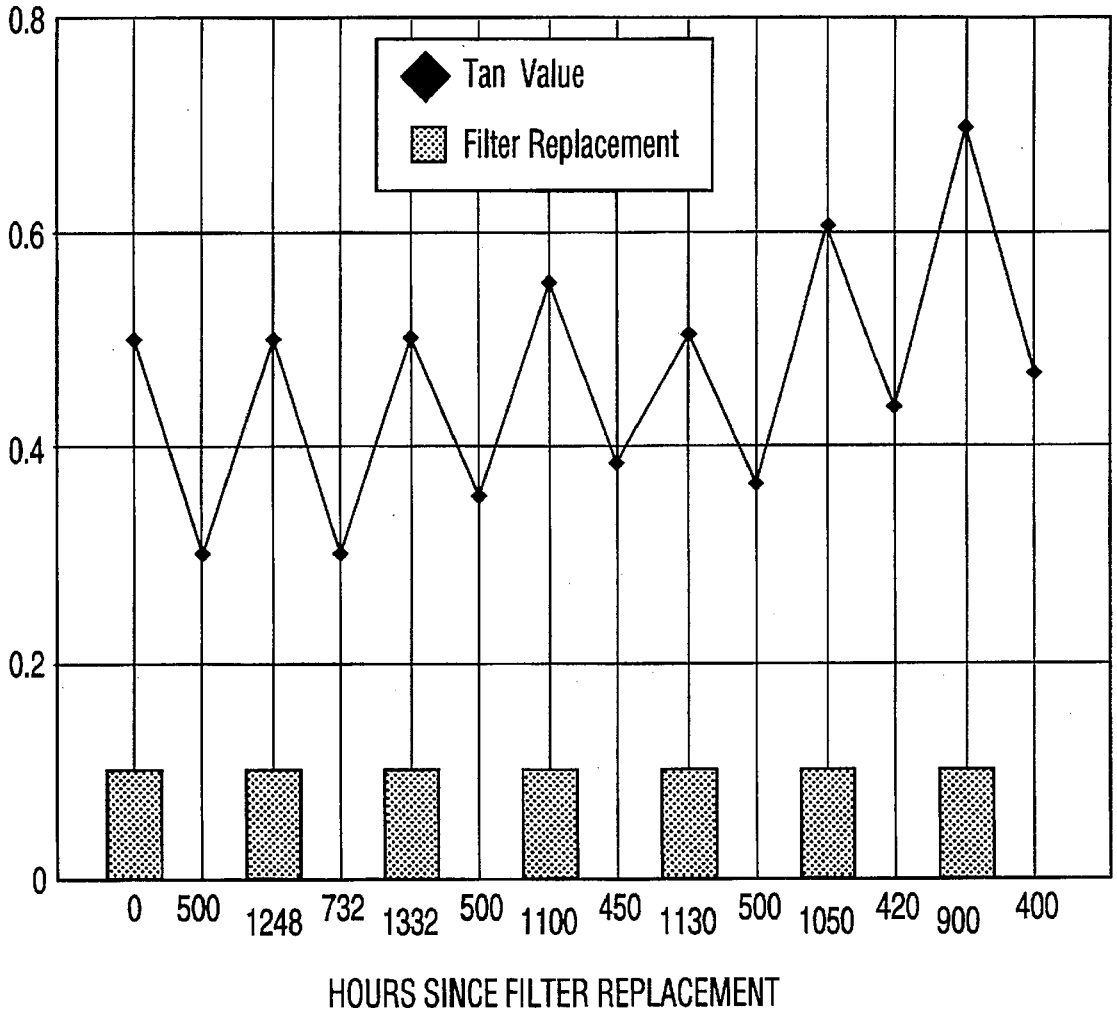
FIG. 2 is a graphical depiction of total acid number value versus filter replacement for interrupted treatment using activated alumina on reservoir A.

For illustrative purposes, FIG. 2 illustrates TAN value as a function of filter replacement on reservoir A using interrupted filtration and activated alumina. As is evident from the data, it can be noted that after approximately 3000 hours of fluid life, a TAN value of 0.30 cannot be maintained and the TAN value gradually increases. In spite of numerous replacements of the activated alumina cartridges, the data clearly illustrates that the TAN value of the fluid continued to increase over the life of the fluid.

Figure 3:
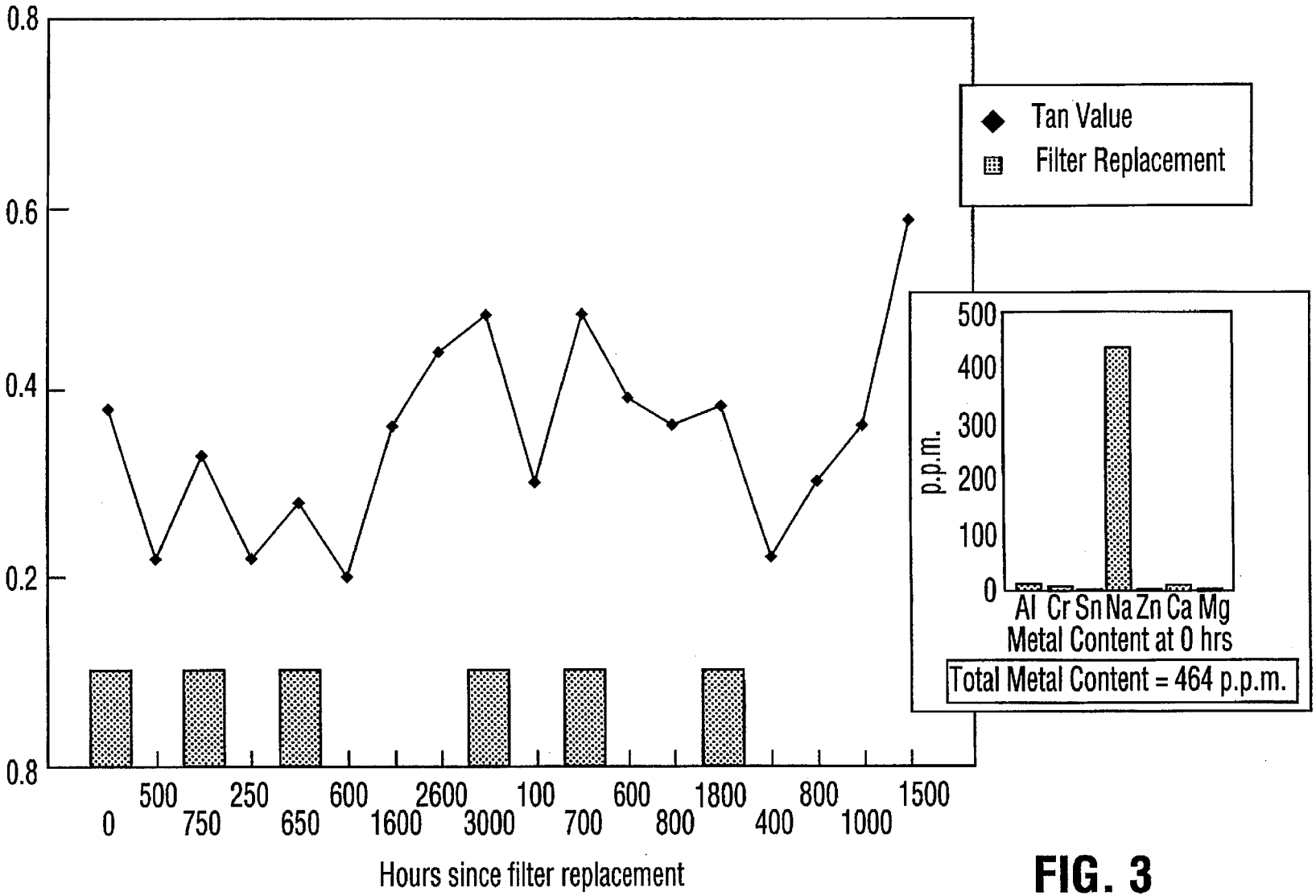
FIG. 3 is a graphical illustration of total acid number as a function of filter replacement for continuous treatment using activated alumina on reservoir A.

Under similar conditions as in FIG. 2, FIG. 3 illustrates data with respect to the activated alumina in reservoir A, but for continuous filtration. The overall fluid life slightly improved, however, after approximately 8500 hours of operation, the fluid TAN reached 0.58. At this point in time, 8 sets of cartridges had been exhausted in an attempt to minimize TAN and cartridge maintenance costs approached 60% of the value of the fluid in the first year of operation. Total fluid metals as illustrated in the inset exceeded 400 p.p.m. Further, acid formation escalated at such a rate that the activated alumina could not reduce overall acid levels.

Figure 4:
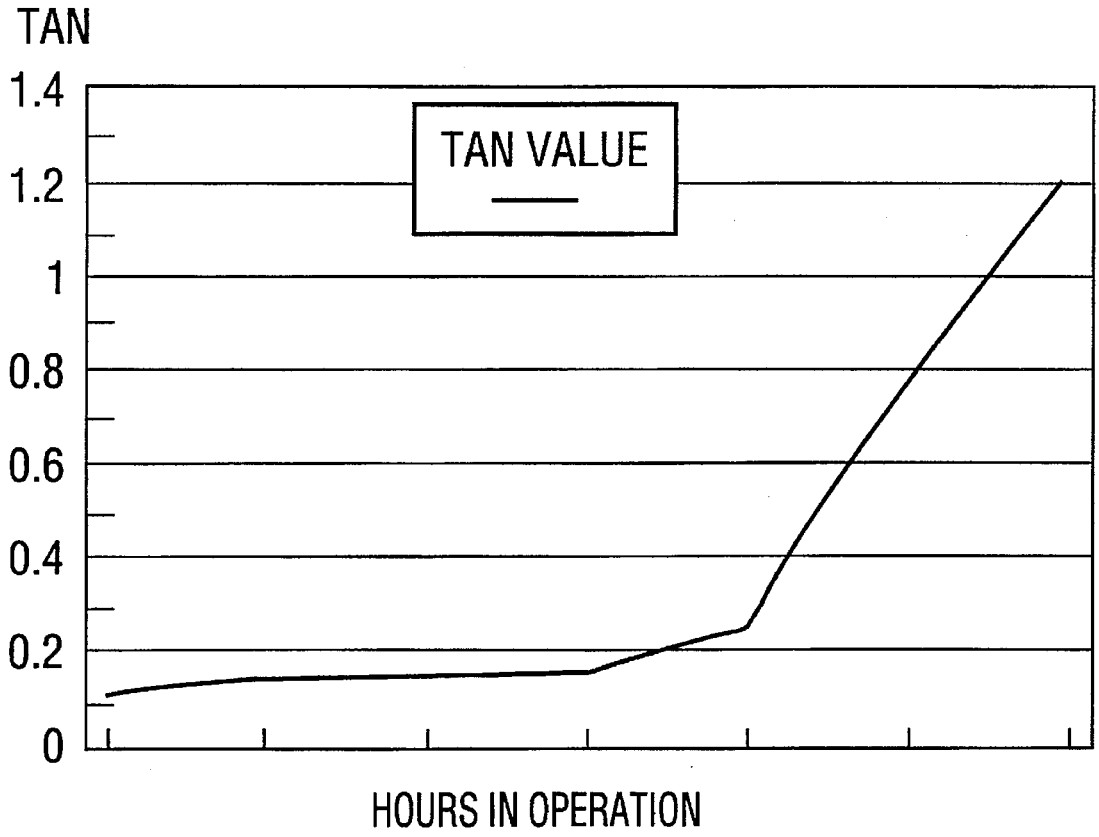
FIG. 4 is a graphical representation of the total acid number as a function of time illustrating the rate of change in total acid number (TAN) due to the hydrolytic stability of phosphate ester fluids.
Figure 5:
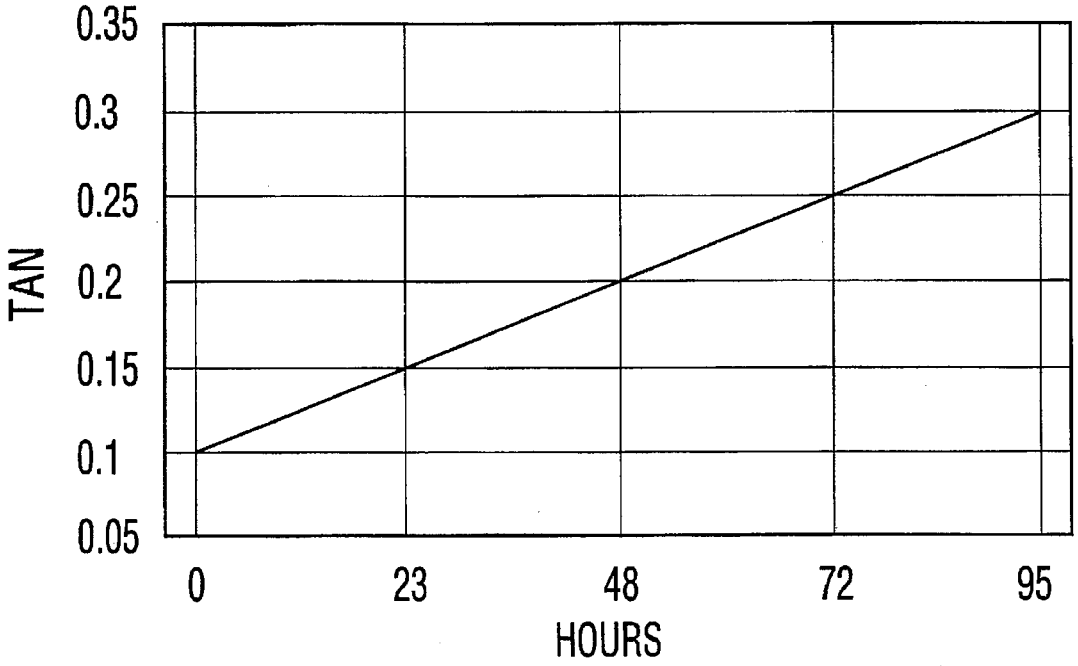
FIG. 5 is a graphical representation of the oxidative stability as a function of total acid number which shows the rate of change in total acid number due to the oxidative stability of phosphate ester fluids.

FIGS. 4 and 5 illustrate data directed to the hydrolytic stability the function of total acid number and the oxidative stability as a function of total acid number. In each case, the rate of change in the TAN is shown for phosphate ester fluids.

FIG. 6 illustrates the metal analysis of new and degraded TBPP fluid. Phosphorus is not included due to the nature of the fluid. All analysis shows phosphorus at over 10,000 p.p.m.

Metal analysis indicated that calcium, magnesium, aluminum, iron, sodium and silicon are present in degraded fluid. Calcium and magnesium resulted from some use over time of the Fuller's earth adsorbent. Aluminum resulted from improper installation of a half micron filter downstream of the activated alumina sorbent, thereby allowing the alumina media to migrate into the lube oil system. The presence of the iron is the result of a small amount of oxidation of the mild steel filters that resulted from a five day delay in installation of the filters after manufacture. The presence of the sodium is the result of numerous activated alumina filter cartridge change outs over a three year period. Introduction of free sodium into the oil system is proportional to the number of activated alumina filter change outs, and exponential to the TAN level of the fluid. Increase in sodium tends to follow the graph of the oxidative stability of the fluid as set forth herein previously with respect to FIG. 5. The presence of silicon is due to the addition thereof as an anti-foam agent. This can vary from 1 to 6 p.p.m.

Figure 7:
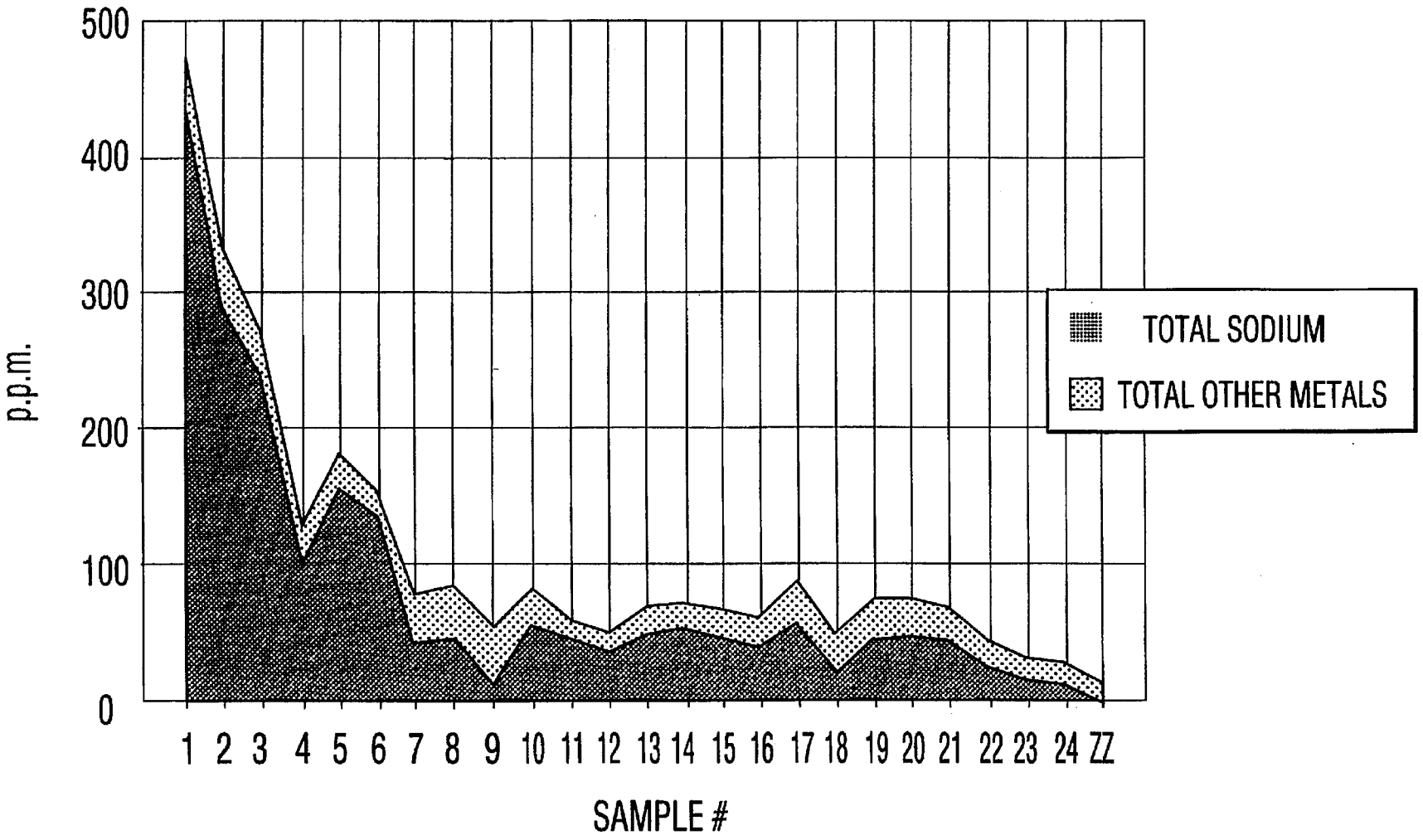
FIG. 7 is a graphical representation of total metals reduction as a function of sample number.

Turning to FIG. 7, shown is a graphical representation of total metals reduction as a function of sample number taken over a period of time. Data is illustrated for a total sodium and total other metals.

Figure 8:
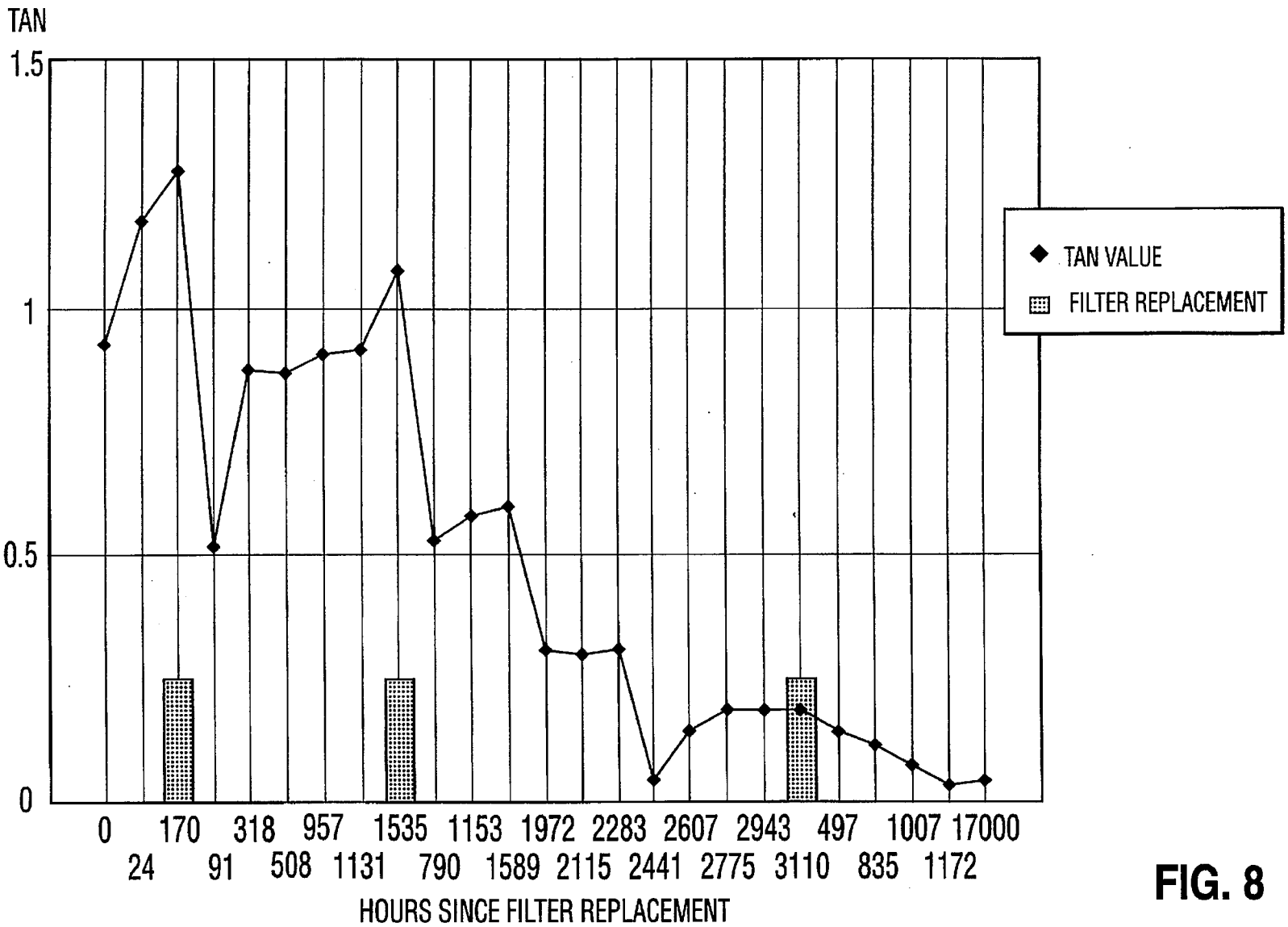
FIG. 8 is a graphical representation of total acid number value as a function of filter replacement for reservoir A under continuous treatment using the Dowex M43 anion resin.

The test on reservoir A was complicated due to the fact that the first set of ion exchange filters that were installed were filled with Dowex M21, a cationic resin. The graph reveals that at 170 hours into the test, the TAN had increased to 1.28 with metals being lowered significantly to 268 p.p.m. New anionic M-43 filters were installed and the TAN was lowered to 0.52 before exhaustion of the filters. The filters were not changed until 1535 hours into the test. The filters were changed with M-43 resin. Both metals and TAN value decreased until 2441 hours into the test at which time the filters were exhausted. They were changed at 3110 hours and metals and TAN value were lowered to near new fluid values. FIG. 8 illustrates the TAN value as a functional filter replacement for the hours set forth herein above.

Figure 9:
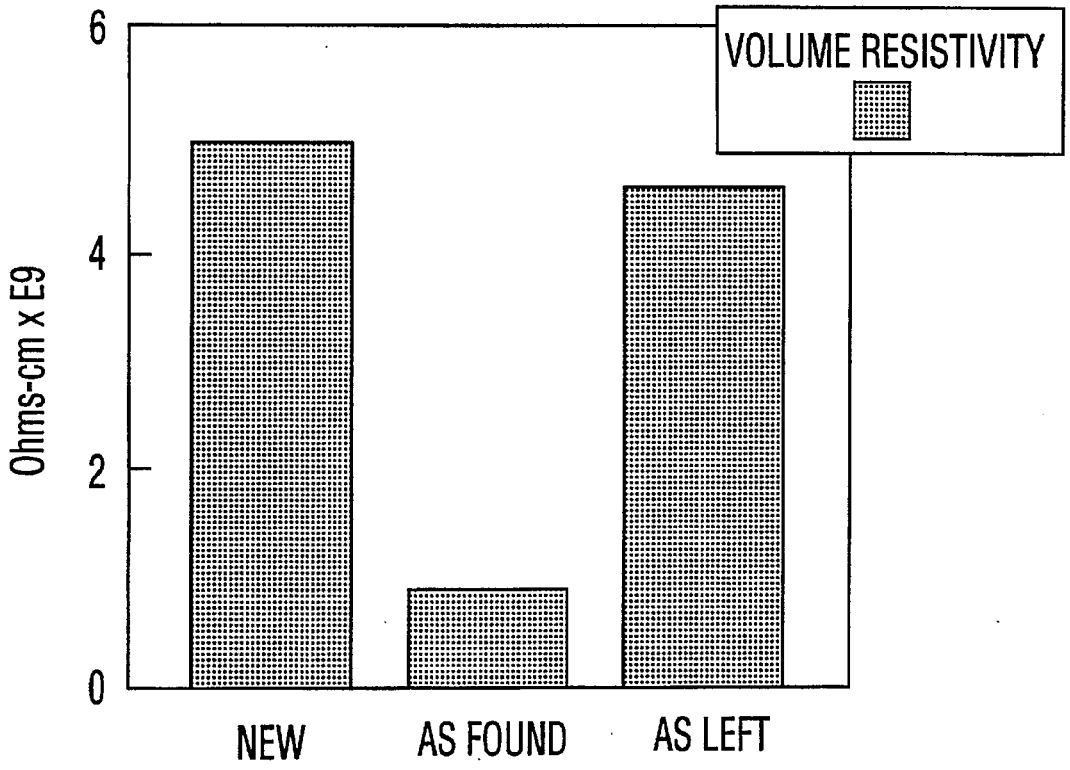
FIG. 9 is a graphical representation of the volume resistivity for fluids from reservoir A illustrating the change in fluid resistivity over the duration of the test and comparing with new fluid values.
Figure 10:
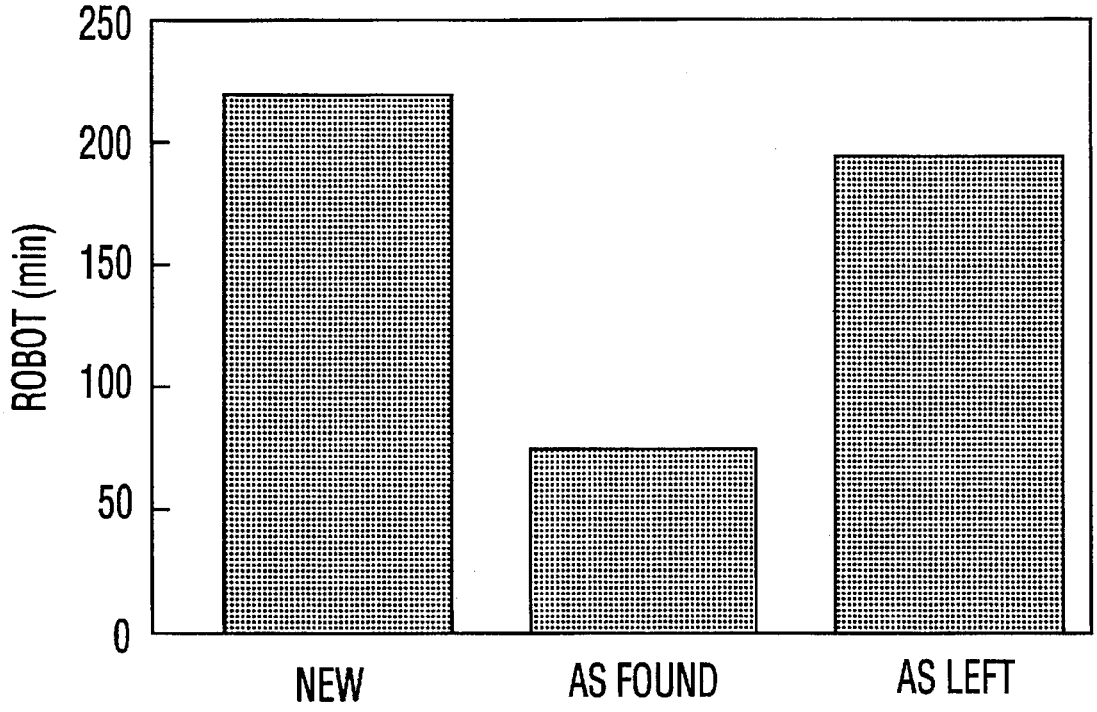
FIG. 10 is a graphical representation of data generated from a rotary bomb oxidation test (RBOT) of the fluid from reservoir A before and after the resin test as compared with new fluid value.

As a further illustration of the utility of the present invention, FIG. 9 illustrates the volume resistivity for a new fluid, a fluid prior to treatment with the anionic resin and for the fluid subsequent to treatment. As is clearly evident in the histogram, the fluid as treated is extremely close to new fluid resistivity values. Similarly, FIG. 10 sets forth a similar comparison on a rotary bomb oxidation test, which test is indicative as to how oxidized fluid is. Clearly, subsequent to treatment with the anionic resin, the treated fluid substantially approximates the oxidation level of the new fluid.

Table 1 illustrates detailed lab analysis data for various test runs for reservoir A using the Dowex M43 resin. Data is tabulated for TAN value, water content, total metal content and a breakdown of individual metals, namely aluminum, chromium, tin, iron, sodium, calcium, magnesium, zinc and silicon.

Figure 11:
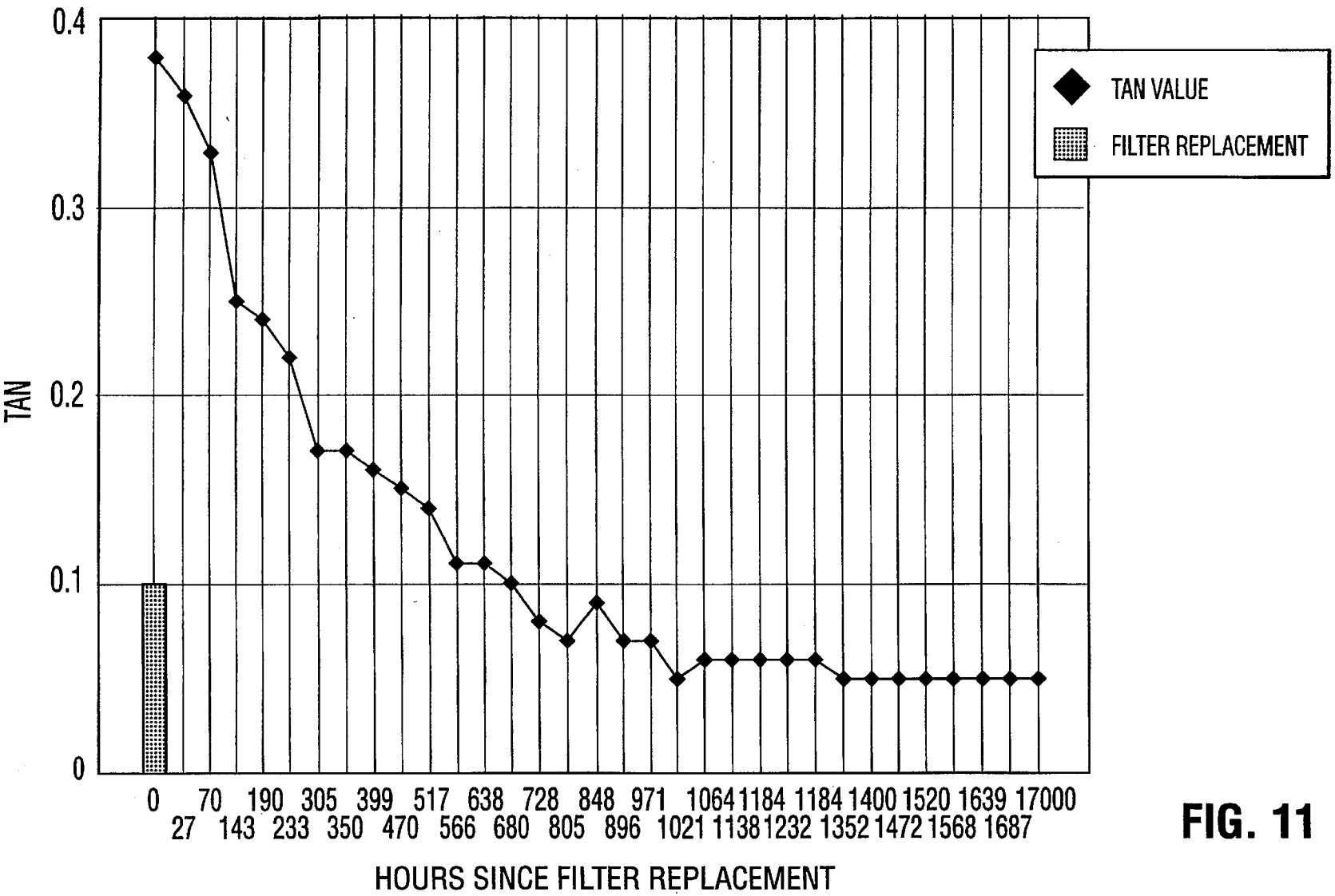
FIG. 11 is a graphical representation of total acid number value as a function of replacement for the fluid from reservoir B under continuous filtration using Dowex M43 anion resin.

Turning to graphical data for reservoir B, FIG. 11 graphically illustrates the TAN value as a function of filter replacement for reservoir B under continuous filtration using the Dowex M43 anion resin.

Figure 12:
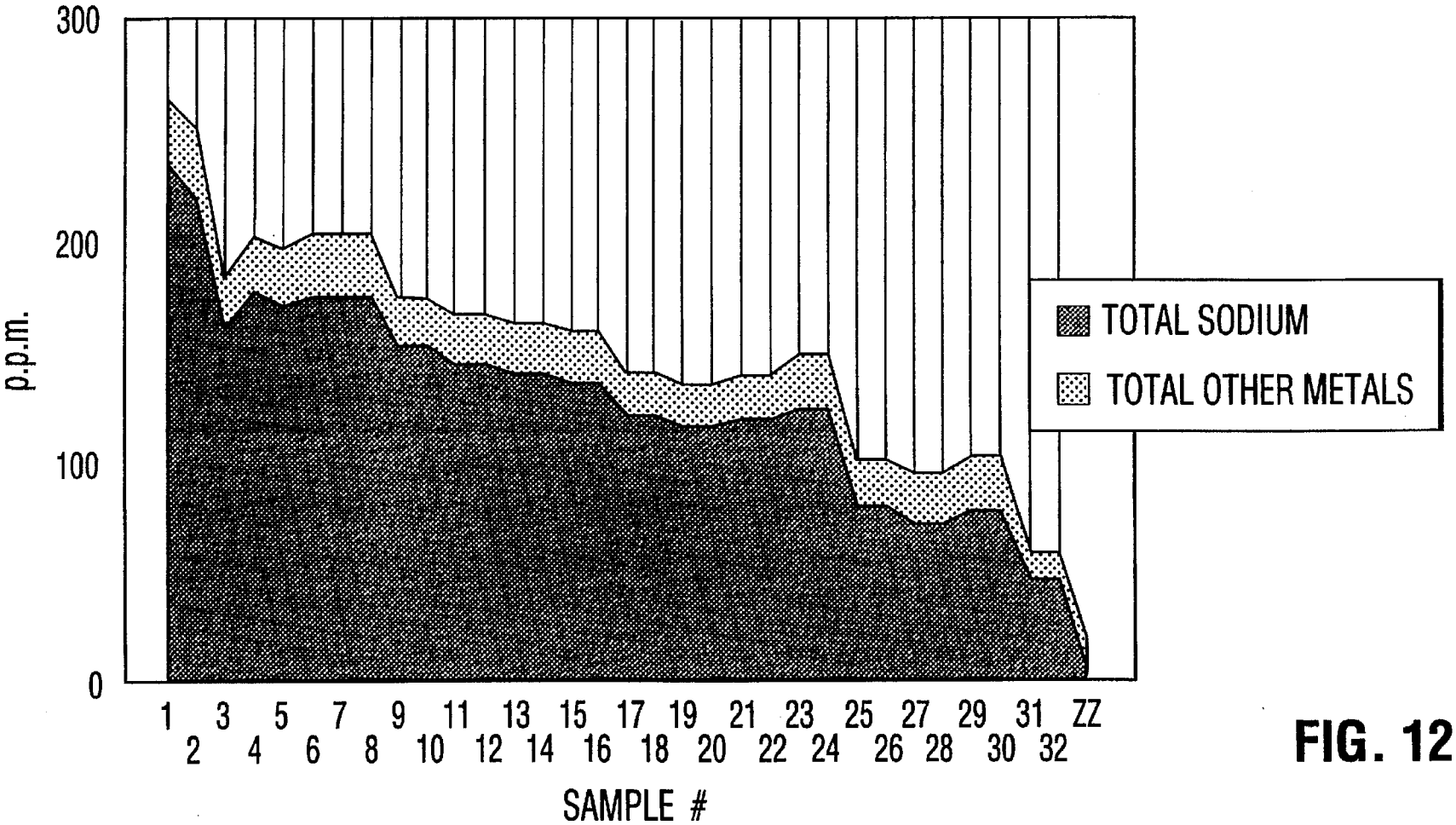
FIG. 12 is a graphical representation of total metal reduction expressed in parts per million as a function of the sample number for reservoir B.

FIG. 12 graphically illustrates the total metals reduction for reservoir B under continuous filtration with data specifically being illustrated for total sodium content as well as a total for other metals in the fluid. There is a clear and steady decline of metal concentration in the fluid over the course of time with the data being exemplary at sample ZZ taken at 17000 hours.

Figure 13:
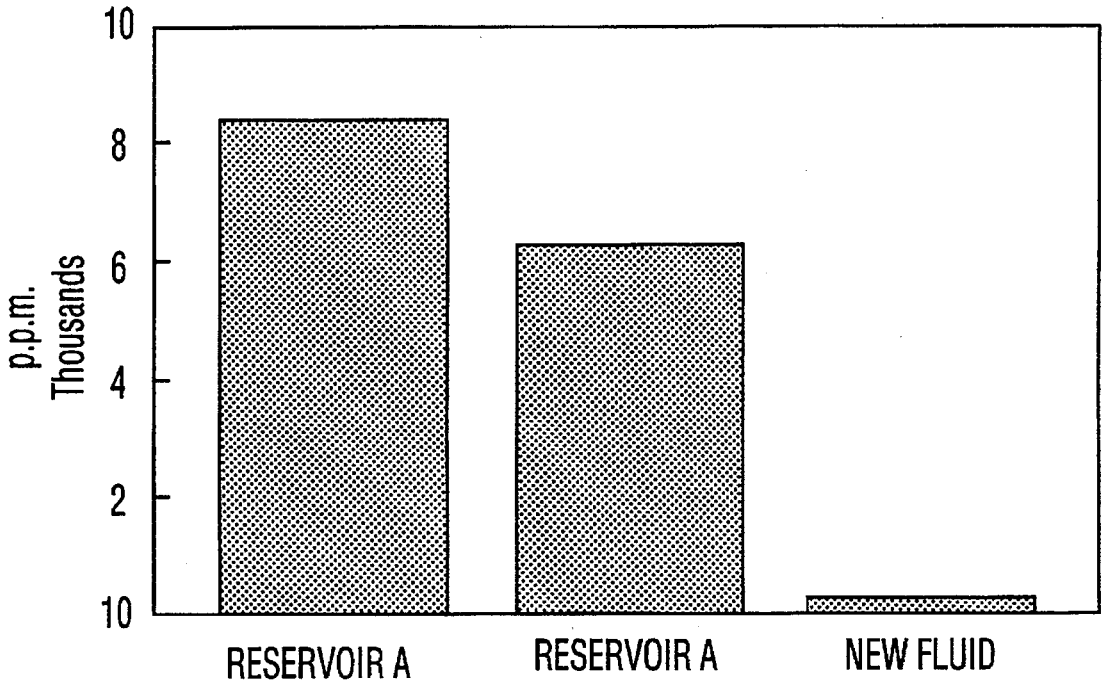
FIG. 13 is a histogram presentation of the phenol content for the fluid in reservoir A, reservoir B and that of a new fluid.

FIG. 13 is a histogram presentation of the phenol content in parts per million for reservoirs A and B as compared to new fluid. This data depicts the phenol content prior to treatment with the sorbent (to be discussed hereinafter).

Generally speaking, high phenol values are indicative of fluid deterioration. In the gas turbine application, the phenols do not need to be removed, but if these compounds are removed, the result is slight improvements to fluid resistivity values, colour and other fluid thermal degradation tests. FIG. 13 illustrates the rate of phenol removal in parts per million using the Purolite MN-150 sorbent.

Data similar to that set forth in Table I with respect to reservoir A is set forth in Table 2 for reservoir B.

Based on the tests conducted on the two degraded phosphate ester fluids used as a main bearing lubricant in gas turbine applications, the use of the polystyrene anionic resin can clearly be said to regenerate severely deteriorated reservoirs to at least 95% of new fluid quality. It is clear that this has significant advantages in terms of eliminating expensive fluid replacement and unnecessary removal of the fluid.

Although embodiments of the invention have been described above, it is not limited thereto and it will be apparent to those skilled in the art that numerous modifications form part of the present invention insofar as they do not depart from the spirit, nature and scope of the claimed and described invention.

TABLE 1

Detailed Lab Analysis
Reservoir A

| | Hrs run | Hrs recycled | Tan | Water | Total Metals | Aluminum | Cr | Sn | Iron | Sodium | Calcium | Magnesium | Zinc | Si |
|---|---|---|---|---|---|---|---|---|---|---|---|---|---|---|
| 1 | 79913 | 0 | 0.93 | 481 | 475 | 10 | 6 | 3 | 0 | 435 | 8 | 1 | 12 | 0 |
| 2 | 79937 | 24 | 1.18 | 1216 | 326 | 8 | 6 | 2 | 3 | 290 | 6 | 0 | 11 | 0 |
| 3 | 80083 | 170 | 1.28 | 228 | 268 | 6 | 7 | 2 | 3 | 238 | 7 | 0 | 5 | 0 |
| 4 | 80174 | 91 | 0.52 | 3138 | 124 | 6 | 6 | 0 | 4 | 100 | 3 | 0 | 5 | 0 |
| 5 | 80401 | 318 | 0.88 | 102 | 181 | 3 | 8 | 0 | 3 | 160 | 5 | 0 | 2 | 0 |
| 6 | 80591 | 508 | 0.87 | 116 | 156 | 4 | 7 | 0 | 3 | 138 | 3 | 0 | 1 | 0 |
| 7 | 81040 | 957 | 0.91 | 3224 | 75 | 1 | 8 | 2 | 14 | 44 | 5 | 0 | 1 | 0 |
| 8 | 81214 | 1131 | 0.92 | 3720 | 85 | 3 | 10 | 0 | 18 | 47 | 3 | 2 | 2 | 0 |
| 9 | 81618 | 1535 | 1.08 | 3986 | 50 | 1 | 7 | 3 | 21 | 12 | 5 | 0 | 1 | 1 |
| 10 | 82408 | 790 | 0.53 | 468 | 83 | 1 | 9 | 0 | 10 | 57 | 4 | 0 | 2 | 0 |
| 11 | 82771 | 1153 | 0.58 | 531 | 59 | 1 | 7 | 0 | 4 | 45 | 2 | 0 | 0 | 1 |
| 12 | 83207 | 1589 | 0.6 | 324 | 50 | 1 | 6 | 1 | 4 | 36 | 2 | 0 | 0 | 0 |
| 13 | 83590 | 1972 | 0.31 | 222 | 70 | 5 | 7 | 2 | 3 | 51 | 2 | 0 | 0 | 1 |
| 14 | 83733 | 2115 | 0.3 | 361 | 72 | 5 | 6 | 1 | 3 | 55 | 2 | 0 | 0 | 1 |
| 15 | 83901 | 2283 | 0.31 | 336 | 68 | 8 | 7 | 0 | 2 | 48 | 2 | 1 | 0 | 0 |
| 16 | 84059 | 2441 | 0.05 | 185 | 60 | 8 | 7 | 0 | 2 | 40 | 2 | 1 | 0 | 0 |
| 17 | 84225 | 2607 | 0.15 | 260 | 87 | 13 | 10 | 0 | 4 | 57 | 3 | 0 | 0 | 1 |
| 18 | 84393 | 2775 | 0.19 | 308 | 45 | 12 | 8 | 0 | 4 | 20 | 0 | 1 | 0 | 0 |
| 19 | 84561 | 2943 | 0.19 | 291 | 75 | 12 | 9 | 0 | 3 | 48 | 2 | 1 | 0 | 0 |
| 20 | 84728 | 3110 | 0.2 | 319 | 76 | 12 | 7 | 0 | 4 | 50 | 2 | 1 | 0 | 0 |
| 21 | 85225 | 497 | 0.15 | 262 | 69 | 11 | 7 | 0 | 3 | 45 | 2 | 1 | 0 | 0 |
| 22 | 85563 | 835 | 0.12 | 696 | 44 | 7 | 6 | 0 | 3 | 27 | 1 | 0 | 0 | 0 |
| 23 | 85735 | 1007 | 0.08 | 210 | 33 | 6 | 6 | 0 | 2 | 18 | 1 | 0 | 0 | 0 |
| 24 | 85900 | 1172 | 0.04 | 136 | 30 | 6 | 6 | 0 | 2 | 15 | 1 | 0 | 0 | 0 |
| ZZ | 98067 | 17000 | 0.05 | 84 | 16 | 5 | 6 | 0 | 1 | 3 | 0 | 1 | 0 | 1 |

TABLE 2

Detailed Lab Analysis
Reservoir B

| | Hrs run | Hrs recycled | Tan | Water | Total Metals | Al | Cr | Sn | Fe | Na | Ca | Mg | Si |
|---|---|---|---|---|---|---|---|---|---|---|---|---|---|
| 1 | 88487 | 0 | 0.38 | 86 | 264 | 13 | 9 | 0 | 1 | 236 | 4 | 1 | 0 |
| 2 | 88514 | 27 | 0.36 | 214 | 251 | 13 | 10 | 1 | 1 | 219 | 4 | 1 | 2 |
| 3 | 88557 | 70 | 0.33 | 132 | 182 | 10 | 7 | 1 | 1 | 159 | 3 | 0 | 1 |
| 4 | 88630 | 143 | 0.25 | 104 | 203 | 11 | 8 | 1 | 1 | 178 | 3 | 0 | 1 |
| 5 | 88677 | 190 | 0.24 | 118 | 196 | 11 | 8 | 1 | 1 | 171 | 3 | 0 | 1 |
| 6 | 88720 | 233 | 0.22 | 106 | 204 | 12 | 10 | 2 | 2 | 175 | 3 | 0 | 0 |
| 7 | 88792 | 305 | 0.17 | 154 | 204 | 12 | 10 | 2 | 2 | 175 | 3 | 0 | 0 |
| 8 | 88837 | 350 | 0.17 | 181 | 204 | 12 | 10 | 2 | 2 | 175 | 3 | 0 | 0 |
| 9 | 88886 | 399 | 0.16 | 173 | 175 | 10 | 8 | 0 | 1 | 153 | 3 | 0 | 0 |
| 10 | 88957 | 470 | 0.15 | 105 | 175 | 10 | 8 | 0 | 1 | 153 | 3 | 0 | 0 |
| 11 | 89004 | 517 | 0.14 | 83 | 168 | 10 | 8 | 0 | 2 | 145 | 3 | 0 | 0 |
| 12 | 89053 | 566 | 0.11 | 99 | 168 | 10 | 8 | 0 | 2 | 145 | 3 | 0 | 0 |
| 13 | 89125 | 638 | 0.11 | 88 | 163 | 10 | 8 | 0 | 3 | 140 | 1 | 1 | 0 |
| 14 | 89167 | 680 | 0.1 | 117 | 163 | 10 | 8 | 0 | 3 | 140 | 1 | 1 | 0 |
| 15 | 89215 | 728 | 0.08 | 122 | 160 | 10 | 8 | 0 | 2 | 136 | 3 | 1 | 0 |
| 16 | 89292 | 805 | 0.07 | 59 | 160 | 10 | 8 | 0 | 2 | 136 | 3 | 1 | 0 |
| 17 | 89335 | 848 | 0.09 | 80 | 141 | 7 | 7 | 0 | 1 | 121 | 3 | 2 | 0 |
| 18 | 89383 | 896 | 0.07 | 74 | 141 | 7 | 7 | 0 | 1 | 121 | 3 | 2 | 0 |

TABLE 2-continued

| | | | | Detailed Lab Analysis Reservoir B | | | | | | | | | |
|---|---|---|---|---|---|---|---|---|---|---|---|---|---|
| | Hrs run | Hrs recycled | Tan | Water | Total Metals | Al | Cr | Sn | Fe | Na | Ca | Mg | Si |
| 19 | 89458 | 971 | 0.07 | 65 | 136 | 7 | 7 | 0 | 1 | 116 | 3 | 2 | 0 |
| 20 | 89508 | 1021 | 0.05 | 96 | 136 | 7 | 7 | 0 | 1 | 116 | 3 | 2 | 0 |
| 21 | 89551 | 1064 | 0.06 | 121 | 140 | 7 | 7 | 0 | 1 | 120 | 3 | 2 | 0 |
| 22 | 89625 | 1138 | 0.06 | 107 | 140 | 7 | 7 | 0 | 1 | 120 | 3 | 2 | 0 |
| 23 | 89671 | 1184 | 0.06 | 81 | 150 | 10 | 7 | 2 | 2 | 124 | 4 | 1 | 0 |
| 24 | 89719 | 1232 | 0.06 | 89 | 150 | 10 | 7 | 2 | 2 | 124 | 4 | 1 | 0 |
| 25 | 89671 | 1184 | 0.06 | 139 | 102 | 8 | 5 | 1 | 2 | 80 | 5 | 1 | 0 |
| 26 | 89839 | 1352 | 0.05 | 152 | 102 | 8 | 5 | 1 | 2 | 80 | 5 | 1 | 0 |
| 27 | 89887 | 1400 | 0.05 | 126 | 96 | 8 | 5 | 4 | 2 | 72 | 4 | 1 | 0 |
| 28 | 89959 | 1472 | 0.05 | 174 | 96 | 8 | 5 | 4 | 2 | 72 | 4 | 1 | 0 |
| 29 | 90007 | 1520 | 0.05 | 242 | 103 | 8 | 6 | 1 | 2 | 78 | 4 | 4 | 0 |
| 30 | 90055 | 1568 | 0.05 | 218 | 103 | 8 | 6 | 1 | 2 | 78 | 4 | 4 | 0 |
| 31 | 90126 | 1639 | 0.05 | 198 | 60 | 6 | 6 | 0 | 0 | 47 | 1 | 0 | 0 |
| 32 | 90174 | 1687 | 0.05 | 205 | 60 | 6 | 6 | 0 | 0 | 47 | 1 | 0 | 0 |
| ZZ | 107174 | 17000 | 0.05 | 120 | 17 | 5 | 6 | 0 | 1 | 3 | 0 | 1 | 1 |

I claim:

1. A method of cleansing a phosphate ester lubricant fluid contaminated with metal material and phosphorous based acids to a new fluid quality having a total acid number of 0.03, said method consisting essentially of:

providing a source of phosphate ester lubricant contaminated with at least one metal selected from the group consisting of aluminum, chromium, tin, iron, sodium, calcium, magnesium and silicon and phosphorous based acids;

providing a source of an anionic resin;

passing said phosphate ester lubricant fluid contaminated with said metal and said acids into contact with said resin; and removing said metal compounds and said acids with said resin to provide a substantially contaminant free reusable lubricatant fluid of a new fluid quality having a total acid number of 0.03.

2. The method as set forth in claim 1, further including an additional filtration step of passing said substantially contaminant free lubricating fluid through a source of a polymeric sorbent for removal of any remaining contaminants.

3. The method as set forth in claim 1, further including the step of recirculating said substantially contaminant free lubricating fluid through said anionic resin.

4. The method as set forth in claim 2, further including the step of recirculating the fluid having been exposed to the said additional filtration step through said system.

5. The method as set forth in claim 1, wherein said method is a continuous method.

6. The method as set forth in claim 1, wherein said phosphate ester lubricating fluid comprises an isopropylphenyl phosphate ester.

7. The method as set forth in claim 1, wherein said phosphate ester lubricating fluid comprises tertiarybutylphenyl phosphate.

8. The method as set forth in claim 1, wherein said acids include phosphorous and phosphoric acid.

9. A method of regenerating a phosphate ester lubricatant fluid contaminated with metal material selected from the group consisting of aluminum, chromium, tin, iron, sodium, calcium, magnesium and silicon and phosphorous based acidified contaminants to new fluid quality having a total acid number of 0.03, consisting essentially of:

providing a source of a polystyrene anionic resin;

passing said contaminated fluid into contact with said polystyrene anionic resin to remove said metal material and said acidified contaminants to regenerate said lubricating fluid to a substantially contaminant free reusable lubricating fluid of a new fluid quality having a total acid number of 0.03.

10. The method as set forth in claim 9, further including the step of passing fluid treated with said anionic resin into contact with a polymeric sorbent resin.

11. The method as set forth in claim 9, wherein said polystyrene anionic resin comprises Dowex™ M43 anionic resin.

12. The method as set forth in claim 10, wherein said polymeric sorbent comprises Purolite MN-150 polymeric ion exchange sorbent.

13. The method as set forth in claim 9, wherein said phosphate ester lubricating fluid comprises isopropylphenyl phosphate ester.

14. The method as set forth claim 9, wherein said phosphate ester lubricating fluid comprises tertiarybutylphenol phosphate.

15. The method as set forth in claim 9, wherein said method is a continuous method.

16. The method as set forth in claim 9, wherein said method is a closed circuit method.

* * * * *

US005661117B1

REEXAMINATION CERTIFICATE (4142nd)

United States Patent [19] [11] B1 5,661,117

Dufresne [45] Certificate Issued Aug. 29, 2000

[54] REGENERATION OF PHOSPHATE ESTER LUBRICATING FLUIDS

[76] Inventor: Peter Dufresne, 428 Coachlight Bay S.W., Calgary, Alberta, Canada, T3H 1Z2

Reexamination Request:
No. 90/005,088, Aug. 26, 1997

Reexamination Certificate for:

| | |
|---|---|
| Patent No.: | **5,661,117** |
| Issued: | **Aug. 26, 1997** |
| Appl. No.: | **08/421,771** |
| Filed: | **Apr. 14, 1995** |

[51] Int. Cl.[7] ..... C10M 137/04
[52] U.S. Cl. ..... 508/433; 558/150; 75/710
[58] Field of Search ..... 508/433; 558/150; 75/710

[56] References Cited

U.S. PATENT DOCUMENTS

| | | | |
|---|---|---|---|
| 3,331,662 | 7/1967 | Feller | 23/123 |
| 3,351,669 | 11/1967 | Anderson et al. | 260/621 |
| 3,708,508 | 1/1973 | Schultz | 252/364 |
| 4,092,378 | 5/1978 | Damiani | 558/150 |
| 4,205,023 | 5/1980 | Anzerberger, Sr. | 260/990 |
| 4,264,534 | 4/1981 | Anzenberger | 558/150 |
| 4,302,335 | 11/1981 | Habermas | 210/651 |
| 4,376,706 | 3/1983 | Scott | 210/678 |
| 4,741,857 | 5/1988 | Horwitz et al. | 252/78.5 |
| 5,364,452 | 11/1994 | Cupertino et al. | 423/22 |
| 5,464,551 | 11/1995 | Deetman | 252/78.5 |

FOREIGN PATENT DOCUMENTS

94/25550 11/1994 WIPO .

OTHER PUBLICATIONS

F. C.J. Brandt, G. Braun, and R. Trost, *Der Maschinenschaden*, 57(5), 194–196 (1984) and translation.

R. L. Albright and P.A. Yarnell, "Iou–Exchange Polymers," in *Encyclopedia of Polymer Science and Engineering*, vol. 8. Wiley–Interscience, New York, 1987, p. 376–377.

*Primary Examiner*—J V Howard

[57] ABSTRACT

A method of removing contaminated phosphate ester materials is provided. The method involves the use of an anionic resin and a polymeric sorbent. The contaminated phosphate ester material is passed into contact with the anionic resin and optionally the sorbent. The method is particularly useful since it removes substantially all of the contaminants, generally metal material and acids, from the phosphate ester such that the phosphate ester can be reused for further applications.

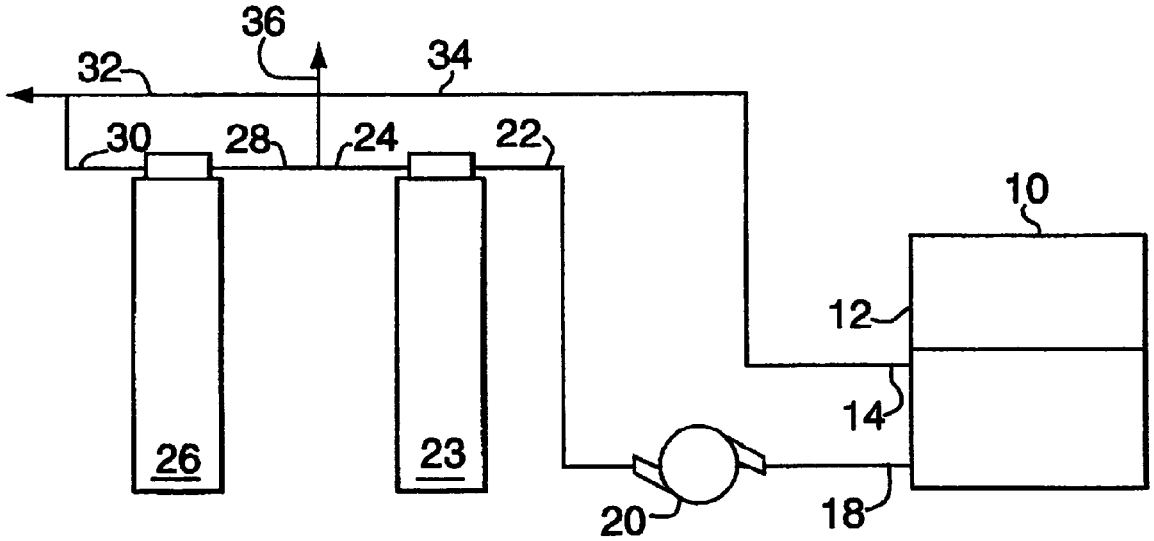

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 3, 5, 15 and 16 are cancelled.

Claims 1 and 9 are determined to be patentable as amended.

Claims 2, 4, 6, 7, 8, 10, 11, 12, 13 and 14 dependent on an amended claim are determined to be patentable.

1. A method of cleansing a phosphate ester lubricant fluid, *circulating within an apparatus performing a mechanical operation and* contaminated with metal material and phosphorous based acids, to a new fluid quality having a total acid number of 0.03, said method consisting essentially of:

providing a source of phosphate ester lubricant *circulating within an apparatus performing a mechanical operation and* contaminated with at least one metal selected from the group consisting of aluminum, chromium, tin, iron, sodium, calcium, magnesium and silicon and phosphorous based acids;

providing a source of anionic resin *as a filter within a cartridge in fluid communication with said apparatus, said resin having a moisture content of at least about 50%*;

passing said phosphate ester lubricant fluid contaminated with said metal and said acids into contact with said resin; and removing said metal compounds and said acids with said resin *by replacing said filter at a periodicity of up to 27 months when there is an increase in TAN about 0.07* to provide a substantially contaminant free reusable lubricant fluid of a new quality having a total acid number of 0.03.

9. A method of regenerating a phosphate ester lubricant fluid, *circulating within an apparatus performing a mechanical operation and* contaminated with metal material selected from the group consisting of aluminum, chromium, tin, iron, sodium, calcium, magnesium and silicon and phosphorous based acidified contaminants to a new fluid quality having a total acid number of 0.03, said method consisting essentially of:

providing a source of polystyrene anionic resin *as a filter within a cartridge in fluid communication with said apparatus, said resin having a moisture content of at least about 50%*;

passing said contaminated fluid into contact with said polystyrene anionic resin *and further replacing said resin at a periodicity of up to 27 months when there is an increase in TAN above 0.07* to remove said metal material and said acidified contaminants to regenerate said lubricating fluid to a substantially contaminant free reusable lubricant fluid of a new fluid quality having a total acid number of 0.03.

* * * * *